United States Patent [19]

Urion

[11] 4,376,017

[45] Mar. 8, 1983

[54] METHODS OF ELECTROLYTICALLY TREATING PORTIONS OF DIGITATED STRIPS AND TREATING CELL

[75] Inventor: Kendall D. Urion, Raymore, Mo.

[73] Assignee: Western Electric Co., Inc., New York, N.Y.

[21] Appl. No.: 337,053

[22] Filed: Jan. 4, 1982

[51] Int. Cl.[3] ..... C25D 5/02; C25D 17/06

[52] U.S. Cl. ..... 204/15; 204/224 R

[58] Field of Search ..... 204/15, 224 R

[56] References Cited

U.S. PATENT DOCUMENTS

| | | | |
|---|---|---|---|
| 4,186,062 | 1/1980 | Eidschun | 204/15 |
| 4,224,117 | 9/1980 | Edwards | 204/15 |
| 4,249,689 | 2/1981 | Voytko | 226/172 |

*Primary Examiner*—T. M. Tufariello

*Attorney, Agent, or Firm*—W. O. Schellin

[57] ABSTRACT

A pair of opposite surfaces (17 and 18) of shaped, digitated edge features (12) of a metal strip (11) are selectively treated in an electrolytic treating cell (32) while adjacent edge surfaces (22 and 23) of such features are shielded from exposure to the treatment. The desired treatment, such as a gold plating process, is accomplished on two opposite, outwardly facing surfaces of a strip of center carried pins by engaging the strip with lateral masking belts having complementary edge features. The strip and the masking belts are passed through a treating cell between paired off electrodes (40 and 41). An electric field between each electrode and the respective, adjacent surface of the strip (11) accomplishes the treatment. Slotted openings through the masking belts relieve pressure differentials in the electrolyte on either side of the strip to minimize fluid flow through gaps between the digitated strip and the masking belts.

10 Claims, 9 Drawing Figures

METHODS OF ELECTROLYTICALLY TREATING PORTIONS OF DIGITATED STRIPS AND TREATING CELL

TECHNICAL FIELD

This invention relates to electrolytically treating portions of a digitated strip and to an electrolytic treating cell. The invention is particularly useful and is described with respect to an apparatus for plating selected portions of a continuous strip of indeterminate length of material having contoured edges, such as a strip of contact pins, prior to their separation into individual pins.

BACKGROUND OF THE INVENTION

According to current practice in the electronics industry, various electrical metal components, such as contact pins, are manufactured in strip form. These strips are typically separated into individual components as one of the last operations prior to assembling the components into a larger piece of electrical apparatus.

One type of operation which conveniently may be applied while the components are still in the form of a strip, is an electrolytic treating operation, such as etching or plating. In a plating operation, for example, the entire strip is cathodically coupled into a plating circuit, and the strip is moved lengthwise through an electrolytic plating bath past a plating anode.

Often, such an electrolytic treating operation is desirably applied to only portions of the components. Various ways of masking are known. It is, for example, possible to paint or screen print a selective masking layer directly onto predetermined portions of the strip prior to the electrolytic treatment. Such masking layer is then removed after the treatment. If the shape of the components in the strip is intricate, applying such a mask is often not feasible.

Also, a pair of endless belts, positioned for parallel, adjacent travel for one common portion of their path, have been used to mask a desired portion of articles. Such a masking operation is, for example, shown in U.S. Pat. No. 4,186,062 to Eidschun. The patent discloses the belts as a conveying and masking instrumentality for a plurality of printed wiring boards. The boards, sandwiched between the belts, enter a plating cell. The resulting plated layer is terminated at a demarcation line defined by the edges of the belts.

In another apparatus for plating portions of a strip with contoured edges, a plating cell is structured to include a closely spaced pair of masking walls between which portions of the strip slide through the cell. Only portions of the strip not protected by the masking wall are subjected to treatment. In the latter example, disclosed in U.S. Pat. No. 4,224,117 to M. J. Edwards et al., an electrolyte further flows through spaces in the contoured edges of the strip to enhance plating of edge surfaces perpendicular to the length of the strip.

Both the technique of masking with a belt and that of masking with stationary walls result in treating all article portions which are conductively coupled into the electrolytic treating circuit and are exposed to the electrolyte. The result is that typically all conductive areas in a longitudinal region parallel to the direction of travel of the articles are treated.

In a strip of articles, such as back plane wiring pins or connector pins, for example, only portions of the pins in longitudinal regions along the length of the strip wherein mating connector contacts engage the pins are gold plated. In order to further reduce the use of gold, it becomes desirable, however, to limit the plating of gold of a desired thickness even within such longitudinal region to less than all four surfaces of a contact pin of typically a square cross section. This is desirable since mating contact elements typically engage only two opposite surfaces of each pin, while the two remaining pin surfaces are never contacted by a mating element.

SUMMARY OF THE INVENTION

In accordance with the invention, each pair of oppositely outward directed surfaces of a strip of recurring edge features is preferentially treated in a electrolytic bath. A preferred embodiment entails substantially blocking open spaces between such recurring edge features with an interdigitated, coplanar masking belt. As the belt and the strip move in unison through an electrolytic treating cell, the combined major surfaces of the belt and the strip effectively divide the cell into separate treating cubicles. A separate electrode in each of the cubicles acts separately on its adjacent surface of the strip. The field interaction of the electrodes in each of the chambers appears to add to the effect of the belt in protecting the surfaces perpendicular to the length of the strip from undesired treatment, such as the deposit of gold when the electrolytic treatment is a gold plating treatment.

BRIEF DESCRIPTION OF THE DRAWING

The following detailed description of the invention and a preferred embodiment thereof will be best understood when read in reference to the accompanying drawing, wherein.

DETAILED DESCRIPTION

1. The Product

Figure 1:
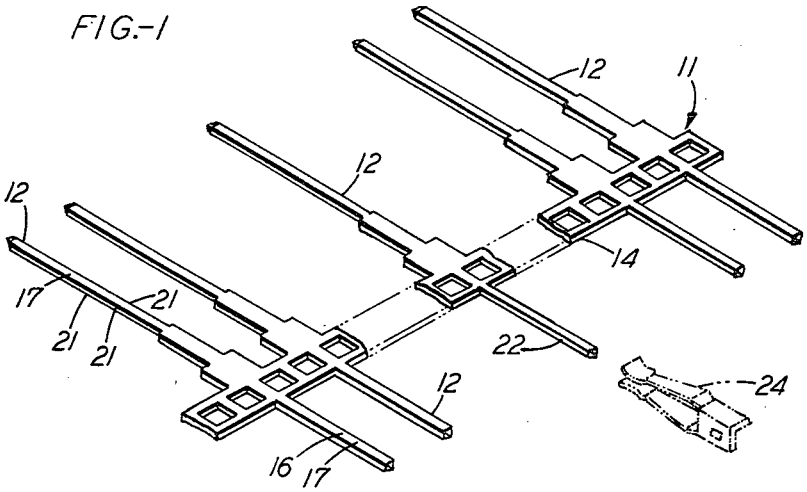
FIG. 1 shows a strip of contact pins as a typical product to which the invention advantageously applies.
Figure 2:
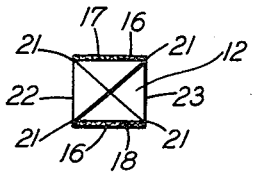
FIG. 2 is an end view of a single pin of the strip in FIG. 1.

FIG. 1 shows a strip 11 of pins 12 which are interconnected by a carrier band 14. The pins 12 are a typical example of a product to which the invention advantageously applies. The invention is not concerned, however, with the particular material of the strip, except that it is typically a metal, nor is the invention concerned with any particular process by means of which the strip may have been cut or formed into its shape. The invention is, therefore, not limited to a technique or apparatus for processing the precise configuration of articles, such as the pins 12 shown in FIG. 1. In a preferred embodiment of the invention the treatment is a gold plating operation to deposit hard contact layers 16 of gold on two opposite surfaces 17 and 18 (see FIG. 2) of the pins 12. The surfaces of interest 17 and 18 coincide with the original major surfaces of the strip 11.

Limiting the gold deposits on the pins 12 to predetermined portions of the two opposite surfaces 17 and 18 allows a gold savings to be achieved without having to incur, at the same time, a detrimental effect on the functional properties of the pins 12. The portions of the pins 12 which ultimately serve as posts for wrapped wires still receive gold deposits on all four corners or edges 21 of the pin, even though the deposits of gold are minimal on two remaining surfaces 22 and 23 of the pins 12, since good corner contact on wire wrapped post is critical to low resistance connections, a desired integrity of the wire wrapped connection is maintained.

Furthermore, when standard connector terminals 24 (see phantom outlines thereof in FIG. 1) are pushed over the pins 12, the mating terminals 24 contact only two of the four surfaces of the pins 12. By correctly orienting all the pins 12 alike during their insertion into a backpanel or wiring board (not shown), contact by the terminals 24 to the gold plated surfaces 17 and 18 is assured.

2. The Apparatus

Figure 3:
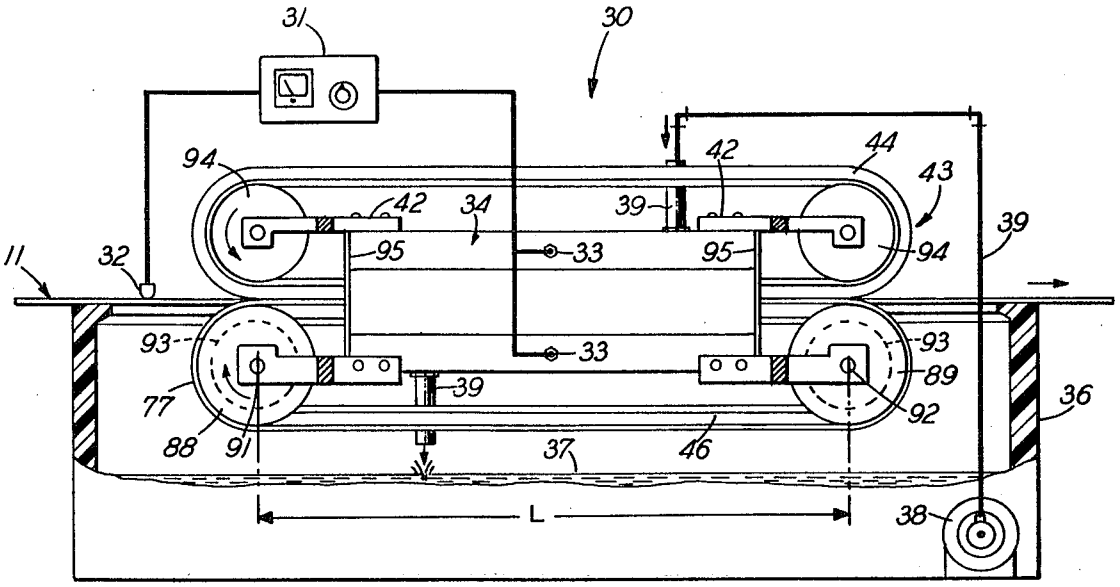
FIG. 3 shows on a smaller scale a partially cut away view of an apparatus for treating a strip of components, such as a strip of the pins shown in FIG. 1, in accordance with the present invention.

FIG. 3 is a side view of an electrolytic treating apparatus 30 for processing the strip 11 in a desired manner. The apparatus 30 features typical equipment of electrolytic treating apparatus, such as an electrical power and control unit 31 with typical electrical leads and with connections 32 and 33 to the strip 11 and to a treating cell 34, respectively. Such typical equipment further includes an overflow tank or reservoir 36 to retain a suitable treating fluid or electrolyte 37, and a pump 38 and typical plumbing 39 leading from the reservoir 36 to the treating cell 34. In the present example wherein the desired treating process is a gold plating operation, the electrolyte 37 may be any suitable electrolytic gold plating solution, as, for example, a gold cyanide bath. The control unit 31 is set to charge the strip 11 negatively with respect to upper and lower electrodes 40 and 41 which are mounted inside the cell 34 (see FIG. 4).

Referring back to FIG. 3, the treating cell 34 is mounted to a support frame 42 of a guiding and masking conveyor assembly 43. In the conveyor assembly 43, an upper guiding belt 44 is mounted directly above a lower guiding belt 46. An inner path length L of the belts 44 and 46 is common to the peripheries of both belts, such that, as the strip 11 is inserted between the belts 44 and 46, the strip 11 is grasped and carried between the belts 44 and 46 through the cell 34.

Figure 4:
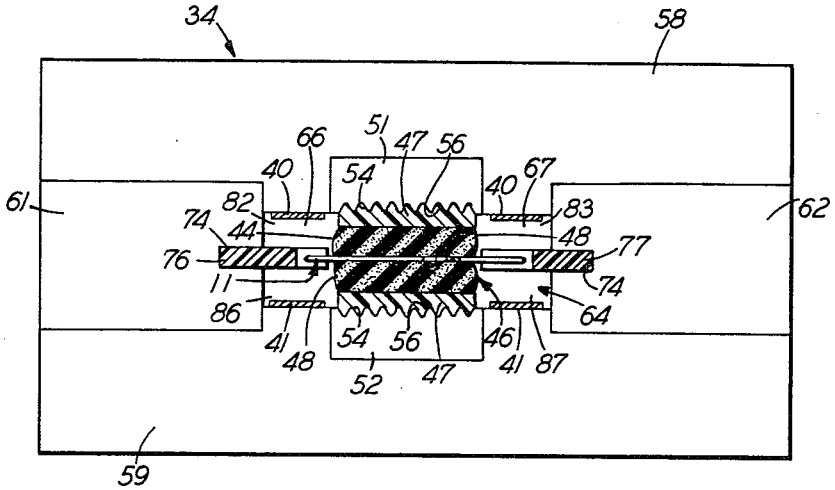
FIG. 4 is a view of a treating cell of the apparatus shown in FIG. 3 as seen from an end of the cell with treating fluid retaining end baffles removed.

FIG. 4, as an end view of or section through the cell 34, shows the position of the belts 44 and 46 relative to each other and in relationship to the cell 34. The belts 44 and 46 are of compound structure. Drive profiles 47 of the belts 44 and 46 are preferably of a multi-V structure, such as those sold under the Tradename of Poly-V. Outer layers 48 of the belts which lie adjacent to one another in the common path L are preferably of a closed cell neoprene foam. The drive profile material is a typical synthetic fiber reinforced neoprene.

As seen in FIG. 4, the spacing between the belts 44 and 46 in their common path L and particularly within the cell is slightly less than what the overall height of the total profile of the belts (the sectional heights of the drive profiles 47 and the outer layer 48 combined) would establish without compression. To securely grasp the strip 11 and to also provide some shielding of the strip 11 from exposure to the electrolyte while within the cell 34, some vertical compression of the belts 44 and 46 was found to be desirable. Depending on the density of the foam of the layer 48 a profile compression of the layer 48 of approximately five percent of its normal thickness is believed to be ideal. However, compressions of up to ten percent may be desired.

To achieve a uniform amount of compression on the two belts 44 and 46 as the belts and the strip 11 move through the cell 34, two respective belt guides 51 and 52 back the belts 44 and 46. The function of the belt guides 51 and 52 is twofold. One of their functions, of course, is to provide backing for the belts to thereby control the perpendicular spacing of the belts 44 and 46 with respect to each other within the cell. The other function of the belt guides 51 and 52 is to maintain the lateral position of the belts 44 and 46 with respect to each other and to the cell 34.

Care should be taken to minimize the friction between the belt guides 51 and 52 and the respective belts 44 and 46. A guiding surface 54 on each of the belt guides 51 and 52 is consequently shaped to a profile of a bottoming V-groove. The difference between the typical profile of a drive pulley and the profile of the surface 54 is that the average width of the grooves on a drive pulley is less than the average width of the V-belt. Consequently, the sloped side surfaces of a belt on a pulley remain in contact with the side surfaces of the grooves of the pulley. In contrast thereto, the average width of grooves 56 of the guiding surface 54 is slightly greater than the average width of the V's on the belts 44 and 46. The perpendicular support on the belt is therefore established primarily between the roots and the tips of the profiles such that the sloped sides engage each other with a minimum amount of force.

The resulting, primarily perpendicular contact minimizes the friction between the belts 44 and 46 and the respective guides 51 and 52. To further minimize the friction therebetween, a preferred material for the guides 51 and 52 in the present example is a tetrafluoroethylene such as that sold under the Tradename, Teflon.

The view of the cell 34 in FIG. 4 shows the belt guides 51 and 52 mounted in an upper cell cover 58 and a lower cell cover 59, respectively. The upper and lower cell covers 58 and 59 are mutually spaced by lateral spacer blocks 61 and 62. The spacer blocks 61 and 62 together with the upper and lower cell covers form a single cell cavity 64. The cell cavity, in turn, is bounded by the inner walls of the spacer blocks 61 and 62.

In the embodiment of FIG. 3, and as shown in FIG. 4, the centered path of the belts 44 and 46 through the cavity 64 effectively divides the cavity 64 into two laterally disposed, similar treating chambers 66 and 67. Each of the treating chambers 66 and 67 feature separate upper and lower electrodes 40 and 41, respectively. The electrodes are preferably mounted immediately to the right and to the left of the belt guides 51 and 52 on the inner walls of the upper and lower cell covers 58 and 59.

Figure 8:
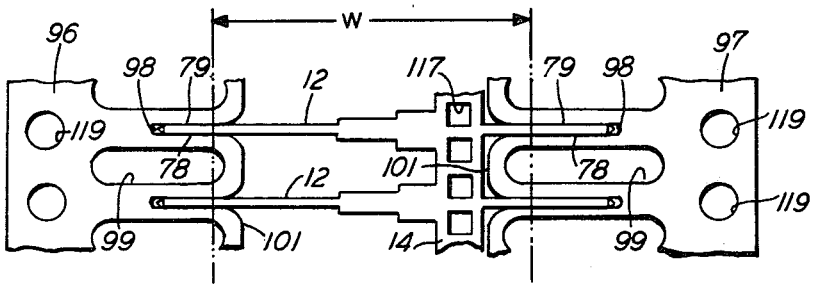
FIG. 8 is a top view of a typical masking belt of the present invention in interdigitated engagement with a strip of articles such as the pins shown in FIG. 1.

The spacer blocks 61 and 62 further feature a horizontal guide slot 74 which is centered on the plane of contact between the belts 44 and 46, as shown in FIG. 4. The guide slots 74 in each of the blocks 61 and 62 receive and guide respective edge masking belts 76 and 77 through the cell 34. Referring briefly ahead to FIG. 8, where an alternate embodiment to that of the belts 76 and 77 is shown in a plan view, the contour of one edge 78 of the edge masking belts 76, for example, and a similar contour of the masking belt 77 substantially complements the edge contours of such portions 79 of the strip 11 which protrude from between the belts 44 and 46 or from otherwise provided masking in a central region W shown in FIG. 8.

The width of the belts 76 and 77 extends, in the embodiment shown in FIG. 4, from the base of the guide slots 74 into proximity of the adjacent sides of the belts 44 and 46. The edge masking belts 76 and 77 in combination with the strip 11 as shown in FIG. 4, divide each of the treating chambers 66 and 67 into upper treating cubicles 82 and 83, and lower treating cubicles 86 and 87, respectively. The edge masking belts 76 and 77 are preferably of a plastic material such as polypropylene, which is inert to typical electrolytic treating solutions. To achieve a desired stiffness for the single-edge supported belts 76 and 77 shown in FIG. 4, the belts 76 and 77 have a preferred thickness of about 1.25 mm which is about twice the thickness of the material forming the strip of the pins 12.

In the described embodiment of FIGS. 3 and 4, the masking belts 76 and 77 are preferably driven and guided by pulleys 88 and 89 which are rigidly pinned to shafts 91 and 92. The shafts 91 and 92 also support central pulleys 93 which guide and drive the lower belt 46. In a similar manner, the upper belt 44 is guided and supported by corresponding pulleys 94. Of course it should be realized that various modifications in the drive arrangement are possible. For example, it is considered to be within the spirit and scope of this invention to return the lateral masking belts in a loop either above or below the cell 34.

The independence of the upper treating cubicles 82 and 83 from the lower treating cubicles 86 and 87 becomes apparent from the fact that in operating the cell 34, the electrodes 98 in the upper cubicles 82 and 83 may now be coupled to a voltage which differs from the voltage of the electrodes 69 in the lower cubicles 86 and 87. However, in achieving the preferred results of the present invention, voltages on the upper electrodes 40 which differ from those on the lower electrodes 41 are not necessary. In most treating processes, the upper electrodes 40 would desirably be adjusted to the same voltage as that of the lower electrodes 41. Even though both of these voltages become referenced to the strip 11 as a cathode, the upper cubicles 82 and 83 and the lower cubicles 86 and 87 are able to function substantially independently as treating cells.

Figure 5:
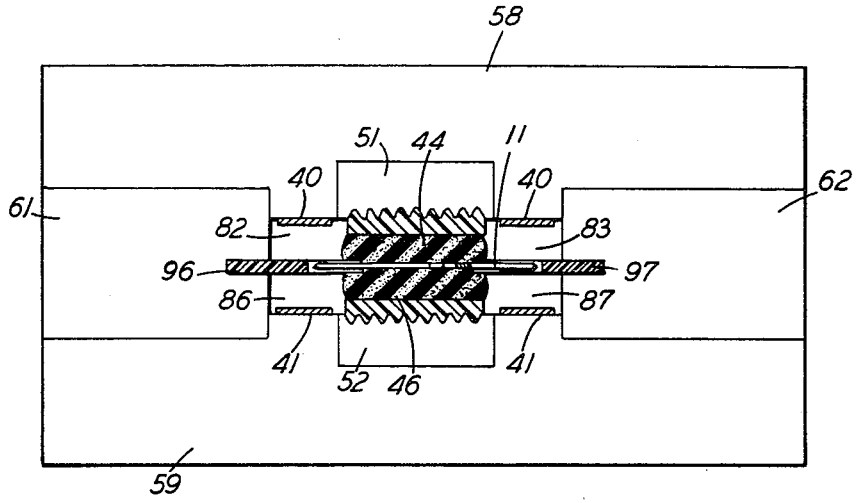
FIG. 5 is a similar view of a treating cell of an alternate embodiment of the apparatus shown in FIG. 3.

FIG. 5 is an end view of an alternate embodiment of the plating cell of FIG. 3 wherein end buffers 95 are omitted. In the embodiment of FIG. 5, masking belts 96 and 97 are extended inwardly to be grasped between the upper and lower belts 44 and 46. Such a modification has an advantage in that the masking belts 96 and 97 are doubly supported, once at their outer edges by the spacer blocks 61 and 62, and then at the tips of their inner edges by the grasp between the upper and lower belts 44 and 46. Since such double support establishes a rather rigid arrangement of the belts 96 and 97 in the plane of the strip 11, the thickness of the belts 96 and 97 is preferred to be about the same as that of the pins 12.

In the sectioned view of FIG. 5, the belts 96 and 97 are shown slightly thicker than the thickness of the strip 11. Thus, where a typical thickness of the material stock for the pins is about 0.63 mm, the thickness of the belts may be preferred to be in a range between 0.65 mm and 0.9 mm. When the material thickness of the belts is substantially the same as or less than the thickness of the pins 12, insufficient masking of the surfaces 22 and 23 may result. Of course, greater thickness of the belts may unduly stress the edges of the outer, resilient layer 48 of the belts 44 and 46.

This latter embodiment is particularly shown in a plan view of FIG. 8. Particularly when the lateral masking belts are of the same thickness as the pins 12, it is further preferred to minimize gaps 98 between the pins 12 and such belts 96 and 97. Such lack of open space between the belts 96 and 97 and the pins is desirable because of a loss of lateral shielding by the belts 96 and 97 as a result of their reduced thickness in relationship to the belts 76 and 77 wherein the pins 12 can be nested.

The thicker belts 76 and 77 offer lateral shielding from exposure of the surfaces 22 and 23 to the electrodes 40 or 41. It is further advantageous to improve the shielding by either the thick belts 76 and 77 or by the belts 96 and 97 by eliminating fluid flow through the gaps 98 between the pins 12 and the respective belts. Regularly spaced passages 99 are, therefore, provided in the belts 76, 77 and 96, 97 along their entire lengths. Such passages 99 permit a ready fluid flow between the upper and the lower cubicles to alleviate pressure differentials of the electrolyte in the adjacent cubicles. Such pressure differentials as may be caused by differences in the distribution of electrolyte to the cubicles 82, 83, 86 or 87, might otherwise result in an undesirable cross flow between the upper and lower cubicles.

Referring to FIG. 8 a preferred location of the passages 99 is in the shape of central slots along fingers 101 which become interdigitated with the pins 12. Besides providing a convenient way to relieve any occurring pressure differentials between the upper and the lower cubicles 82 and 83 of the cell, the passages or slots 99 impart a lateral resiliency to the fingers 101. The width of the fingers 101 in the direction of travel may therefore be made equal to the space between adjacent pins. To optimize such resiliency into the very tips of the fingers 101, the passages 99 or slots may extend into the central region W, which is typically masked by the upper and lower belts 44 and 46. As a result, it is possible to contact the side surfaces of the pins directly against the fingers 101 of the lateral belts 96 and 97 or 76 and 77. The resulting resiliency of the fingers 101 is also advantageous to take up differences in length between the lateral belts and the strip 11 which may occur because of thermal expansion differences when temperature variations occur beyond those of a typically preferred operating range between about 40° to 60° C.

Figure 6:
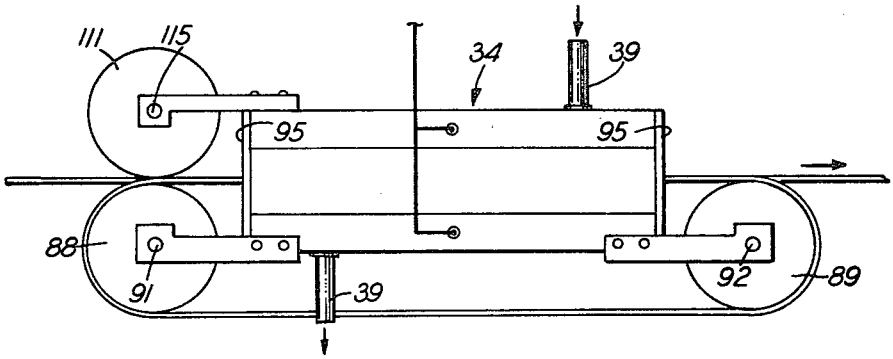
FIG. 6 is an elevational view of a portion about the treating cell of yet a further embodiment of an apparatus capable of treating a strip of components in accordance with the present invention.
Figure 7:
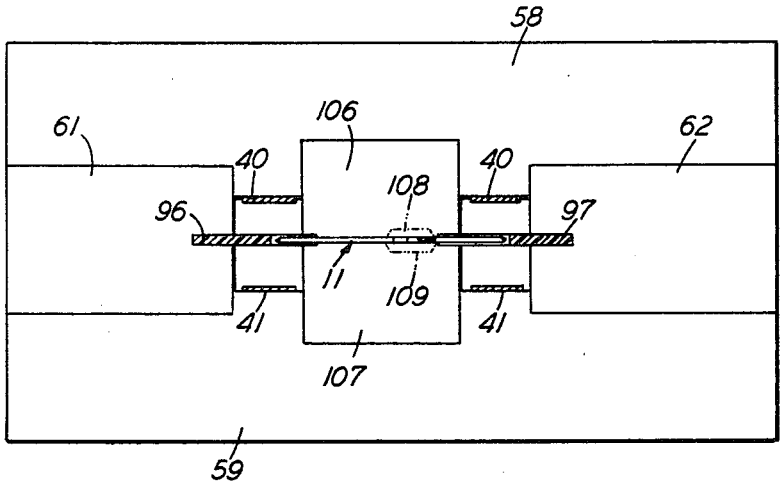
FIG. 7 is an end view of a treating cell of the apparatus of FIG. 6 wherein end baffles have, again, been omitted to afford a view of the cross section of a treating chamber of the cell.

FIG. 6 is a side elevation of an alternate embodiment of the cell 34, wherein the belts 44 and 46 have been replaced by a stationary upper guide 106 and a lower guide 107, respectively, as shown in the end view of the cell 34 in FIG. 7. As seen best in reference to FIG. 6, an advantage of the stationary guides 106 and 107 is an elimination of the belts 44 and 46 and, of course, the associated structure for supporting the pulley and drive system for the belts. A tradeoff for a simplified structure is a decrease in the masking ability of the stationary guides 106 and 107 in comparison with the compressive seal established at demarcation lines (spaced by the dimension W in FIG. 8) at the edges of the cooperating belts 44 and 46.

The stationary guides 106 and 107 which are shown in section in FIG. 7, are preferably of a low friction material as, for example, a tetrafluoroethylene, such as Teflon. If the carrier 14 or any portions of the pins 12 in the center of the strip 11 within the confines of the guides 106 and 107 are formed or sculptured to a shape beyond the flat, original thickness of the strip 11 it may be necessary because of the now unyielding configuration of the guides to form a complementary relief 108 and 109 in the guides 106 and 107, as indicated by the phantom outline in FIG. 7.

Of course, with the elimination of the upper and lower belts 44 and 46, it now becomes desirable to provide a mechanism for engaging, for example, the belts 96 and 97 with the strip 11, such that the belts as well as the strip 11 occupy the same plane as they pass through the cell 34. FIG. 6 shows a guide wheel 111 which is mounted in position of the eliminated pulley 94 adjacent to the entrance of the cell 34. To provide for additional guiding, it may be desirable to further provide a similar guide wheel 111 at the opposite end of the cell 34.

Figure 9:
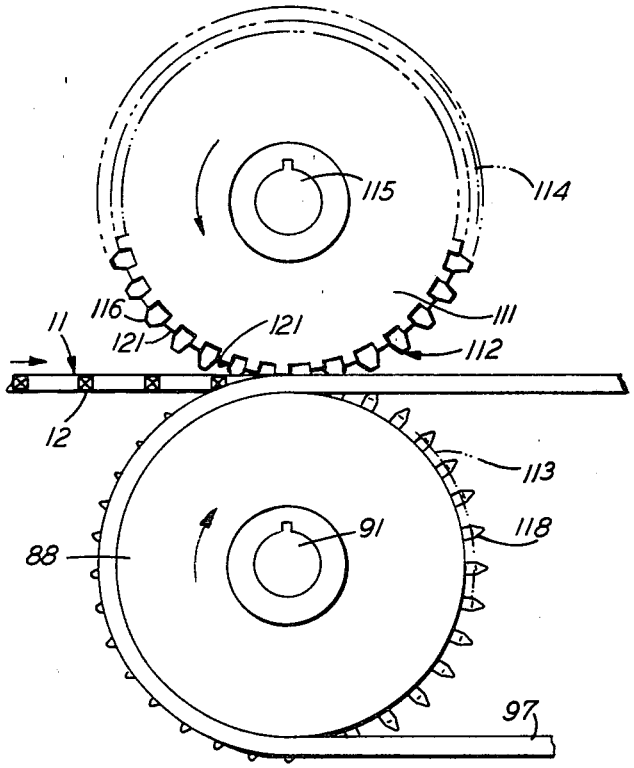
FIG. 9 is an elevational view of a guide wheel for engaging a masking belt with the strip of articles, such guide wheel preferably including a gear drive for synchronizing the speed of the masking belt with the movement of the strip.

FIG. 9 shows the guide wheel 111 in greater detail. The wheel 111 is preferably positioned above the pulleys 88 of the lateral belts 76 and 77 or 96 and 97 and acts in cooperation with the return pulley of the lateral belts for engaging the lateral belts with the strip 11. The guide wheel 111 has a sculptured surface 112 with several features. For example, to achieve a corresponding, synchronous movement between, for example, the belt 97 and the strip 11 (see FIG. 9), the pulley 88 and the wheel 111 are preferably geared together as shown by the pitch circles 113 and 114. The gears represented by the pitch circles 113 and 114 are preferably laterally offset on the apparatus 30 toward one end of the shaft 91 and the corresponding shaft 115 of the wheel 111.

Teeth 116 on the wheel 111 correspond in their lateral position to, for example, square apertures 117 in the carrier band 14 of the strip 11 to engage such apertures or similar, regularly spaced features in the strip 11 to synchronize the movement of the strip 11 with that of the lateral belts (such as the belt 97). In the preferred embodiment, the belts 76 and 77 or 96 and 97 are similarly driven and guided in a positive manner through bullet-shaped feed pins 118 located in the pulleys 88 and 89 which engage matching feed holes 119 (see FIG. 8) in each of the belts.

Referring again to FIG. 9, and in particular to the wheel 111, between the teeth 116 extends a backing surface 121 which tends to move into coincident relationship above each of the pins. The surface 121 is digitated, so as to fit between and not to interfere with the fingers 101 of the lateral belts. The digitated shape of the surface 121 supports the strip 11 and backs each of the pins 12 to permit them to be inserted securely between the fingers 101 of the masking belts.

While the guide wheel 111 is described as being preferably geared to the drive shaft 91 of the masking belts to synchronize the strip 11 with the lateral masking belts, it should be understood, however, that a synchronization between the lateral masking belts and the strip can be achieved by any of a number of ways. For example, it is further contemplated that the movement of the strip 11 into the cell be monitored photo-electrically such as by a commercially available sensor (not shown). The speed of the belt then may be controlled by signals which are an output of such photoelectric sensor.

Of course, when there is a minimum of space between the fingers 101 of the belts and the pins 12 of the strip 11, once the belts 96 and 97, for example, are engaged with the pins 12 and move in a common plane, the problem of synchronization is substantially eliminated when the masking belts 96 and 97, in a freely moving situation, are urged along by the movement of the strip 11 through the cell 34.

As is seen from the above, various modifications of the described apparatus are possible without departing from the spirit and scope of the invention.

What is claimed is:

1. A method of electrolytically treating portions of a laterally digitated strip, wherein the strip is electrically coupled to an electrical circuit, which comprises:

engaging edge features of the strip with complementary edge features of a coplanarly positioned masking belt; and moving the strip with the engaged belt through an electrolytic bath in a treating chamber and through a gap formed by spaced treating electrodes, such that each of two oppositely outward facing surfaces of the strip are exposed to an adjacent one of the electrodes, while edge surfaces of the strip are masked by complementary edge surfaces of the masking belt.

2. A method according to claim 1, wherein moving the strip comprises:

moving the strip substantially centered through the gap between the treating electrodes.

3. A method according to claim 2, further comprising:

communicating fluid between cubicles of the chamber, such cubicles being formed by the strip and the belt within the chamber, through openings within the belt, the periphery of such openings being located totally within the belt.

4. A method according to claim 1, wherein the strip moves through the chamber, said strip being partially masked by opposed masking means extending from opposite walls of said chamber into said chamber and against surfaces of the strip; and the masking belt moves through a guide track in a wall of the treating chamber spaced from said masking means and extending toward such masking means.

5. A method according to claim 4, wherein the strip moves centrally through the chamber, such that digitated edges extend outward toward two opposite walls of the chamber, and said oppositely converging masking means is positioned along the direction of travel of the strip in the center of the chamber; and wherein engaging edge features comprises engaging each of the digitated edges with a separate masking belt, such that the combination of the two masking belts, the masking means and the strip divide the chamber into four cubicles as the strip moves through the chamber.

6. A method according to claim 5, wherein oppositely converging masking means are adjacent, resilient belts which engage center portions of the opposite, outwardly facing surfaces of the strip, and moving the strip comprises, moving the strip with two engaged, coplanarly positioned masking belts and the resilient belts in unison through the treating chamber, such that the exposed surface portions become subjected to the electrolytic bath and to the field established between the strip and the electrodes.

7. Apparatus for electrolytically treating outwardly directed surface portions of a conductive, digitated strip, wherein the strip, coupled into an electric treating circuit, is movably positioned to pass through an electrolytic treating cell having a treating cavity, at least one pair of spaced treating electrodes located in the treating cavity, and means for filling the treating cavity with an electrolytic treating fluid, which comprises:

at least one lateral masking belt, such belt having edge features complementary to edge features of said digitated strip;

means for engaging said complementary edge features of said at least one masking belt with the edge features of said digitated strip;

means for guiding said digitated strip in its movement through the cell to pass through said treating cavity and through a space between said at least one pair of treating electrodes to expose oppositely outwardly directed surfaces of said digitated strip to an electrolytic treating action, while the edge features of said strip remain protected from such electrolytic treating action by said complementary edge features of said at least one masking belt; and means for disengaging said at least one masking belt from said digitated strip after the strip has emerged from said treating cell.

8. Apparatus according to claim 7, wherein said digitated strip comprises a plurality of spaced, parallel pins interconnected by a central carrier band, the apparatus comprising:

a first and a second lateral masking belt, said first lateral masking belt having edge features complementary to one end of the spaced pins, and the second lateral masking belt having edge features complementary to the second end of said pins in said strip, said belts being mounted spaced and in parallel to each other to interdigitatedly engage opposite sides of the strip.

9. Apparatus according to claim 8, wherein said guiding means comprises a first and a second endless guiding belt, said guiding belts being mounted opposite one another in a plane perpendicular to the plane of the strip, such that adjacent portions of said guiding belts grasp a central portion of an upper and lower surface of said strip of pins to advance and guide said pins with the laterally engaged masking belts through said electrolytic treating cell.

10. Apparatus according to claim 9, wherein adjacent portions of said guiding belts external to said treating cell guide said strip of pins into engagement with said lateral masking belts.

* * * * *